US006984106B2

(12) United States Patent
Thompson

(10) Patent No.: US 6,984,106 B2
(45) Date of Patent: Jan. 10, 2006

(54) RESILENT SEAL ON LEADING EDGE OF TURBINE INNER SHROUD

(75) Inventor: Jeff Brian Thompson, Jackson, TN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/752,572

(22) Filed: Jan. 8, 2004

(65) Prior Publication Data

US 2005/0152777 A1 Jul. 14, 2005

(51) Int. Cl.
*F01D 11/08* (2006.01)

(52) U.S. Cl. ..... 415/173.1; 415/173.3; 415/174.2; 415/160

(58) Field of Classification Search ..... 415/173.1, 415/173.3, 174.2, 160
See application file for complete search history.

(56) References Cited

U.S. PATENT DOCUMENTS 6,076,835 A * 6/2000 Ress et al. ..... 417/174.2
6,170,831 B1 * 1/2001 Bouchard ..... 277/355
6,679,680 B2 * 1/2004 Um et al. ..... 415/173.1

* cited by examiner

*Primary Examiner*—Edward K. Look
*Assistant Examiner*—Igor Kershteyn
(74) *Attorney, Agent, or Firm*—Nixon & Vanderhye P.C.

(57) ABSTRACT

A sealing arrangement for a stator shroud segment is provided that includes a resilient seal to reduce air leakage and improve turbine engine efficiency. The stator shroud segment includes an outer shroud having a leading edge groove and a trailing edge groove, and a plurality of inner shrouds each having a leading edge hook and a trailing edge hook. The leading and trailing hooks of each of the inner shrouds are respectively engaged with the leading and trailing edge grooves of the outer shroud so as to connect the inner shrouds to the outer shroud. A resilient shaped seal is located on a leading edge hook of the inner shroud so as to be between the leading hook and a retaining ring that contributes to holding the inner shroud in place.

21 Claims, 2 Drawing Sheets

RESILENT SEAL ON LEADING EDGE OF TURBINE INNER SHROUD

BACKGROUND OF THE INVENTION

The present invention relates to gas turbines, and, in particular, to a resilient seal for reducing air leakage and improving turbine engine efficiency.

In industrial gas turbines, shroud segments are fixed to turbine shell hooks in an annular array about the turbine rotor axis to form an annular shroud radially outwardly and adjacent to the tips of buckets forming part of the turbine rotor. The inner wall of the shroud defines part of the gas path. Conventionally, the shroud segments are comprised of inner and outer shrouds provided with complimentary hooks and grooves adjacent to their leading and trailing edges for joining the inner and outer shrouds to one another. The outer shroud is, in turn, secured to the turbine shell or casing hooks. Typically, each shroud segment has one outer shroud and two or three inner shrouds.

Two common designs have been used for configuring inner shrouds, i.e., an opposite hook design and a C-clip design. The opposite hook design is the more traditional approach and incorporates oppositely projecting hooks on the leading and trailing edges that are retained by the outer shroud.

The C-clip design is schematically illustrated in FIG. 1. As can be seen, like the traditional opposite hook design, the C-clip design also includes leading and trailing edge hooks 10, 12 projecting in opposite directions. However, in the C-clip design, the trailing edge hook 12 is retained with a separate C-clip 14, rather than being retained by the outer shroud 16, as in the opposite hook design.

Traditional inner shroud designs use a sealing scheme around the leading edge hook of the inner shroud. This scheme typically consists of an axial chording gap and a cloth seal segment gap for leakage control around the leading edge hooks. In the chording gap, there is a surface-to-surface gap between parts of the inner shroud and the outer shroud of the turbine. The chording gap is related to thermal chording which forms a gap between mating parts at an elevated temperature. The resulting equivalent gap is generally on the order of five to ten mils. Thus, the chording gap allows a significant amount of air to leak out from between the inner and outer shrouds into the hot gas path of the turbine, which reduces the operating efficiency of the turbine.

The cloth seal segment gap depends on the thermal growth or expansion of the inner shroud due to heating and manufacturing process capabilities. Here again, however, the cloth seal segment gap also allows air to leak out into the gas path of the turbine, again reducing the operating efficiency of the turbine.

A third inner shroud design, which is disclosed in U.S. patent application Ser. No. 10/348,010, filed Jan. 22, 2003, the contents of which are incorporated herein by reference, modifies the traditional stage one inner shroud to reverse the leading edge hooks, as compared to the traditional opposite hook design and the C-clip design. This reverse hook design also allows the use of a resilient seal on the leading edge hook of the inner shroud to improve turbine engine efficiency by reducing air leakage from between the inner and outer shrouds.

BRIEF DESCRIPTION OF THE INVENTION

In an exemplary embodiment of the invention, a sealing arrangement for a stator shroud of a multi-stage gas turbine comprises at least one shroud segment having a leading edge and a trailing edge, each shroud segment comprising an outer shroud and at least one inner shroud connected thereto, the outer shroud having grooves defined adjacent to and along the leading and trailing edges, the at least one inner shroud having a leading edge axially projecting tab portion and a trailing edge axially projecting tab portion for respectively engaging the grooves of the outer shroud, the engagement connecting the inner shroud to the outer shroud, and a resilient seal located on the leading edge axially projecting tab portion of the at least one inner shroud so as to be between the leading edge axially projecting tab portion and a retaining ring that contributes to holding the inner shroud in place. The resilient seal is preferably W-shaped and made from a nickel-based alloy.

In another exemplary embodiment of the invention, a sealing arrangement for a stator shroud segment comprises an outer shroud having a leading edge and a trailing edge, the outer shroud comprising a leading edge hook and a trailing edge hook, both the hooks of the outer shroud projecting in a first axial direction, a plurality of inner shrouds each having a leading edge and a trailing edge, each of the inner shrouds comprising a leading edge hook and a trailing edge hook, both the hooks of the inner shroud projecting in a second, axial direction, diametrically opposite the first axial direction, the leading and trailing hooks of each the inner shroud being respectively engaged with the leading and trailing hooks of the outer shroud, the engagement connecting the inner shroud to the outer shroud, and a resilient seal located on a leading edge of the leading hook of the inner shroud so as to be between the leading hook of the inner shroud and a retaining ring that contributes to holding the inner shroud in place. The resilient seal is preferably W-shaped and made from a nickel-based alloy, such as a product named "Waspaloy".

BRIEF DESCRIPTION OF THE DRAWINGS

These and other objects and advantages of this invention will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
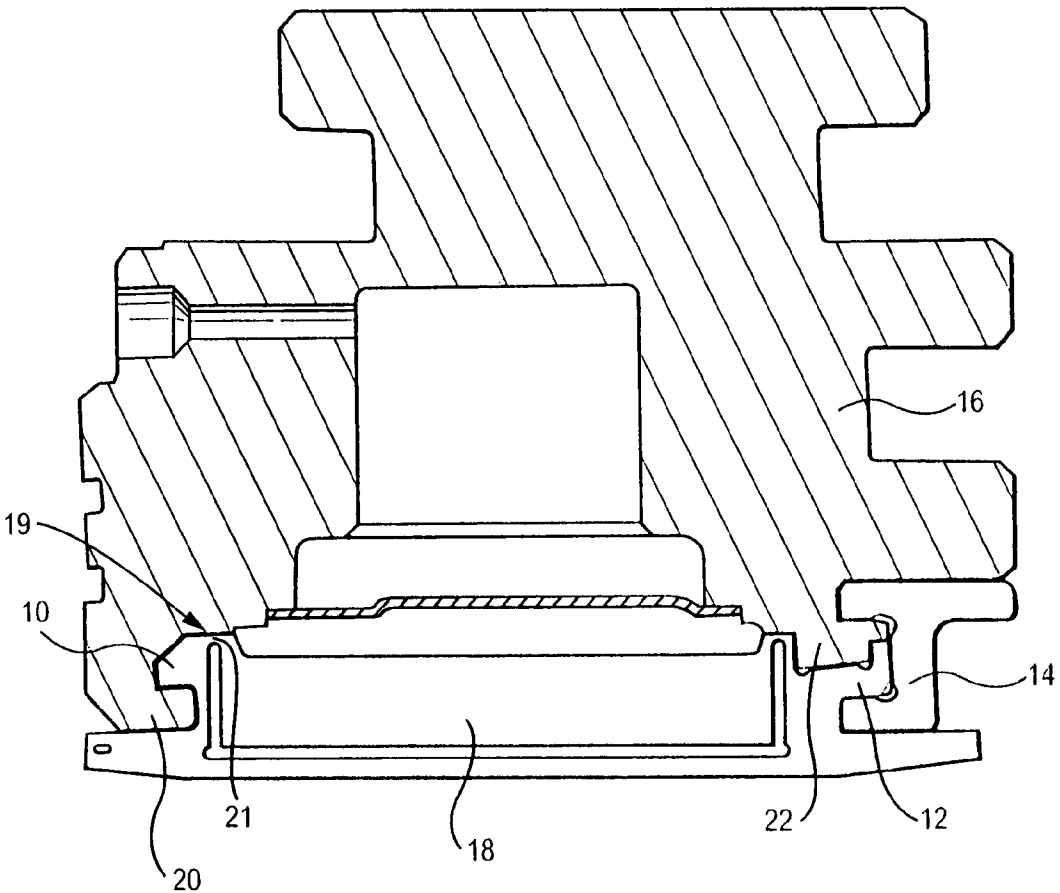
Fig. 1 (PRIOR ART)
FIG. 1 is a schematic shroud segment circumferential end view of the inner shroud and a circumferential section view of the outer shroud, the schematic showing a conventional C-clip inner shroud retention design.

As mentioned above, FIG. 1 schematically illustrates a conventional C-clip design for an inner shroud 18. As shown in FIG. 1, the inner shroud 18 includes an inner shroud leading edge hook 10 and an inner shroud trailing edge hook 12 for engagement with corresponding leading and trailing edge hooks 20, 22 of an outer shroud 16. The inner shroud trailing edge hook 12 is secured to the trailing edge hook 22 of the outer shroud 16 with a separate C-clip 14, rather than being maintained in place by outer shroud 16, as in the traditional opposite hook design. However, like the traditional opposite hook design, the C-clip design includes an axial chording gap 19 and a cloth seal segment gap 21, both at the inner shroud leading edge hook 10.

Figure 2:
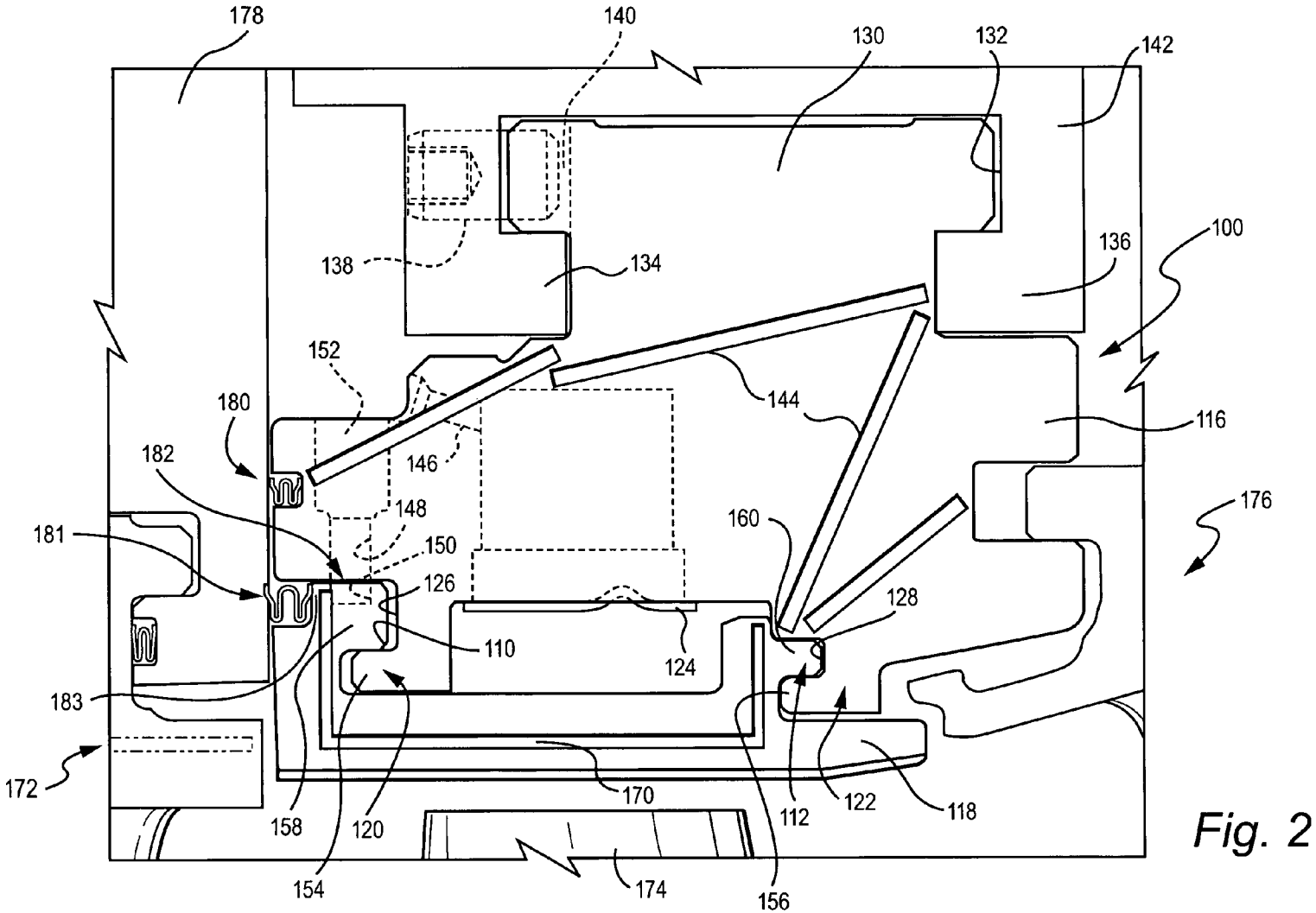
FIG. 2 is a schematic circumferential end view of a shroud segment including an inner shroud with a reverse leading edge hook and the resilient seal of the present invention on the reverse leading edge hook.

Referring to FIG. 2, there is illustrated a shroud segment, generally designated 100, comprised of an outer shroud 116 and a plurality of inner shrouds 118. Although the illustrated shroud segment 100 would typically include two or three inner shrouds 118, only one inner shroud 118 is shown in FIG. 2 for purposes of clarity. As described in greater detail below, the inner shrouds 118 have hooks 110 and 112 adjacent to their leading and trailing edges, respectively, for circumferentially and axially slidable engagement, in final assembly, in grooves 126 and 128 defined by hooks 120,122 of the outer shroud 116. In the illustrated embodiment, an impingement cooling plate 124 is mounted between the shrouds for impingement cooling of the inner wall surfaces of the inner shroud segment 118, in a conventional manner.

In the illustrated embodiment, the outer shroud 116 has a radially outer dovetail 130 for engagement in a dovetail groove 132 defined by leading and trailing hooks 134,136 forming part of the fixed turbine shell or casing for securing the shroud segment to the casing. It will be appreciated that an annular array of shroud segments 100 are formed about the rotor of the gas turbine and about the tips of the buckets on the rotor, thereby defining an outer wall or boundary for the hot gas flowing through the hot gas path of the turbine. In FIG. 2, the inner shroud seal slots 170, the stage one nozzle structure 172, stage one bucket 174 and stage two nozzle structure 176 are shown for completeness and reference.

With reference to FIG. 2, which is a detailed circumferential end view of a shroud segment 100 showing mating parts, it can be seen that a reverse hook shroud configuration is provided to engage and hold the inner shrouds 118 to the outer shroud 116. The outer shroud 116 is engaged by leading and trailing casing hooks 134,136, as described above, and an outer shroud anti-rotation pin 138 is provided to extend into a corresponding slot 140 to circumferentially lock the outer shroud 116 with respect to the casing 142. In the illustrated embodiment, outer shroud seal slots 144 are shown as are air metering holes 146 and impingement plate 124. At the leading edge of the outer shroud, inner shroud anti-rotation pin bores 148 are further provided to align with corresponding holes 150 and to receive inner shroud anti-rotation pins 152.

As further illustrated in FIG. 2, the leading edge hook 120 of the outer shroud 116 is reversed so as to include a tab portion 154 projecting axially upstream, away from the trailing edge. The trailing edge hook 122 of the outer shroud 116 also includes a tab portion 156 that projects axially upstream, toward the leading edge, in the same direction as the tab portion 154 of the leading edge hook 120. Thus, the grooves 126 and 128 of the outer shroud 116 both open axially in the upstream direction.

The hooks 110 and 112 of the inner shroud 118 are engaged with the leading and trailing edge hooks 120, 122, and in particular with the grooves 126, 128 of the outer shroud 116. More particularly, in the illustrated embodiment, the leading edge hook 110 of the inner shroud comprises a tab portion 158 that projects axially downstream, towards the trailing edge, so as to axially and radially engage the hook 120 of the outer shroud 116, to axially and radially lock the outer and inner shrouds. A receptacle or hole 150 is defined in the leading edge hook of the inner shroud for receiving the inner shroud anti-rotation pin 152 inserted through the corresponding bore 148 defined in the outer shroud leading edge portion.

The trailing edge hook 112 of the inner shroud similarly includes a tab portion 160 extending axially downstream, towards the trailing edge, in the same direction as the leading edge tab portion 158 to axially and radially lock with the trailing edge hook 122 of the outer shroud.

According to the present invention, the air leaking out through the chordal gap between the outer shroud 116 and the inner shroud 118 is substantially reduced by the addition of a resilient seal 181 that is positioned between the leading edge hook 110 of inner shroud 118 and a retaining ring 178 that contributes to holding inner shroud 118 in place. Preferably, seal 181 is shaped like a "W" or "E", the bellows of an accordion, the Greek letter "Ω", or any other shape that allows seal 181 to be "springy" or compressible. Seals of this type are made by a number of companies that include the Fluid Sciences business unit of PerkinElmer, Inc. and Advanced Products Company. The use of resilient seal 181 results in a gap on the order of 1 mil (plus segment gaps), which significantly reduces the amount of air flow that leaks from between the leading edge hook 110 and the leading edge groove 126 of shrouds 118, 116, respectively, into the hot gas path of the turbine. Thus, the resilient seal of the present invention is effectively the limiting element of the leakage flow path, providing up to an 80% reduction in this component of the leakage flow over the traditional chording gap arrangement. Resilient seal 181 reduces the amount of air leakage so that more air will pass through the turbine and be available for useful work and cooling, rather than being just wasted energy. This results in a higher operating efficiency for the turbine. The use of resilient seal 181 causes most of the air leakage past seal 180 to be routed into a cavity below plate 124 and reduces leakage out of such cavity below plate 124.

The reversed hook inner shroud design shown in FIG. 2 includes an axial chording gap 182 between the leading edge hook 110 and the leading edge groove 126 of shrouds 118 and 116, respectively, and a cloth seal segment gap 183, also shown in FIG. 2. However, because resilient seal 181 is located at the leading edge hook 110 of inner shroud 118 so as to be between leading edge hook 110 and retaining ring 178 that contributes to holding inner shroud 118 in place, seal 181 substantially blocks the air that leaks through chording gap 182. It should also be noted that seal 181 can be made from a single piece of material or a plurality of pieces of material for all of the inner shrouds 118 positioned in the annular array of shroud segments about the turbine rotor axis. Preferably, seal 181 is made from two pieces of material that each extend half way around the array.

The material from which seal 181 is made is preferably a metal alloy that can withstand the temperatures that are seen at the location of seal 181. When such temperatures range between 1200 to 1300° F., preferably, this metal alloy is a product named "Waspaloy", a nickel-based alloy. For lower temperatures, preferably seal 181 is made from "Inconel 718", another nickel-based alloy. It should be noted that "Waspaloy" and "Inconel 718" are made by many companies, such as, for example, Principal Metals and Diversified Metals, Inc. Seal 181 is resilient, even though it is made from a metal-based material, because it is made in a springy or compressible shape, and it is made using a very thin material.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sealing arrangement for a stator shroud of a multi-stage gas turbine comprising:

at least one shroud segment having a leading edge and a trailing edge, each shroud segment comprising an outer shroud and at least one inner shroud connected thereto;

said outer shroud having a first groove defined adjacent to and along said leading edge and a second groove defined adjacent to and along said trailing edge;

said at least one inner shroud having a leading edge axially projecting tab portion and a trailing edge axially projecting tab portion for respectively engaging said first and second grooves of said outer shroud, said engagement connecting said inner shroud to said outer shroud; and a resilient seal located on said leading edge axially projecting tab portion of said at least one inner shroud so as to be between said leading edge axially projecting tab portion and a retaining ring that contributes to holding said inner shroud in place.

2. A sealing arrangement for a stator shroud as in claim 1, wherein said resilient seal is W-shaped.

3. A sealing arrangement for a stator shroud as in claim 1, wherein said resilient seal is shaped like a greek letter Ω.

4. A sealing arrangement for a stator shroud as in claim 1, comprising a plurality of said inner shrouds connected to said outer shroud, each of said inner shrouds including said resilient seal located on a leading edge axially projecting tab portion of said inner shroud.

5. A sealing arrangement for a stator shroud as in claim 1, wherein said resilient seal is made from a first nickel-based alloy designed to withstand temperatures in the range of 1200 to 1300° F.

6. A sealing arrangement for a stator shroud as in claim 1, wherein said resilient seal is made from a second nickel-based alloy designed to withstand temperatures below 1200° F.

7. A sealing arrangement for a stator shroud as in claim 1, wherein said resilient seal is made from a very thin nickel-based alloy material.

8. A sealing arrangement for a stator shroud as in claim 1, wherein said resilient seal is shaped like an accordion bellows.

9. A sealing arrangement for a stator shroud as in claim 1, wherein said resilient seal is formed from a single piece of material.

10. A sealing arrangement for a stator shroud as in claim 1, wherein said resilient seal is formed from a plurality of pieces of material.

11. A sealing arrangement for a stator shroud segment comprising:

an outer shroud having a leading edge and a trailing edge, said outer shroud comprising a leading edge hook and a trailing edge hook, both said hooks of said outer shroud projecting in a first axial direction;

a plurality of inner shrouds each having a leading edge and a trailing edge, each of said inner shrouds comprising a leading edge hook and a trailing edge hook, both said hooks of said inner shroud projecting in a second axial direction, diametrically opposite said first axial direction;

said leading and trailing edge hooks of each said inner shroud being respectively engaged with said leading and trailing edge hooks of said outer shroud, said engagement connecting said inner shroud to said outer shroud; and a resilient seal located on a leading edge of said leading edge hook of said inner shroud so as to be between said leading edge hook of said inner shroud and a retaining ring that contributes to holding said inner shroud in place.

12. A sealing arrangement for a stator shroud segment as in claim 11, wherein said resilient seal is W-shaped.

13. A sealing arrangement for a stator shroud segment as in claim 11, wherein said resilient seal is shaped like a greek letter Ω.

14. A sealing arrangement for a stator shroud segment as in claim 11, comprising a plurality of said inner shrouds connected to said outer shroud, each of said inner shrouds including said resilient seal located on a leading edge hook of said inner shroud.

15. A sealing arrangement for a stator shroud segment as in claim 11, wherein said resilient seal is made from a first nickel-based alloy designed to withstand temperatures in the range of 1200 to 1300° F.

16. A sealing arrangement for a stator shroud segment as in claim 11, wherein said resilient seal is made from a second nickel-based alloy designed to withstand temperatures below 1200° F.

17. A sealing arrangement for a stator shroud segment as in claim 11, wherein said resilient seal is made from a very thin nickel-based alloy material.

18. A sealing arrangement for a stator shroud segment as in claim 11, wherein said resilient seal is shaped like an accordion bellows.

19. A sealing arrangement for a stator shroud segment as in claim 11, wherein said leading and trailing edge hooks of said outer shroud define respective leading and trailing edge grooves that open in said first direction for respectively receiving therein said leading and trailing edge hooks of said inner shrouds.

20. A sealing arrangement for a stator shroud segment as in claim 11, wherein said resilient seal is formed from a single piece of material.

21. A sealing arrangement for a stator shroud segment as in claim 11, wherein said resilient seal is formed from a plurality of pieces of material.

* * * * *

UNITED STATES PATENT AND TRADEMARK OFFICE

CERTIFICATE OF CORRECTION

PATENT NO. : 6,984,106 B2
APPLICATION NO. : 10/752572
DATED : January 10, 2006
INVENTOR(S) : Thompson It is certified that error appears in the above-identified patent and that said Letters Patent is hereby corrected as shown below:

On the front page at INID code 54 in the title the word "Resilent" should read as --Resilient--

Signed and Sealed this

Twenty-ninth Day of May, 2007

JON W. DUDAS
*Director of the United States Patent and Trademark Office*